US008354797B2

(12) United States Patent
Rudolph

(10) Patent No.: US 8,354,797 B2
(45) Date of Patent: Jan. 15, 2013

(54) CIRCUIT ARRANGEMENT FOR OPERATING A SERIES CIRCUIT OF AT LEAST TWO LOW-PRESSURE GAS-DISCHARGE LAMPS, AND A CORRESPONDING METHOD

(75) Inventor: Bernd Rudolph, Forstern (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 146 days.

(21) Appl. No.: 12/782,726

(22) Filed: May 19, 2010

(65) Prior Publication Data

US 2010/0295459 A1 Nov. 25, 2010

(30) Foreign Application Priority Data

May 20, 2009 (DE) ..... 10 2009 022 072

(51) Int. Cl.

| | |
|---|---|
| ***H05B 37/00*** | (2006.01) |
| ***H05B 39/00*** | (2006.01) |
| ***H05B 41/00*** | (2006.01) |
| *H05B 37/02* | (2006.01) |
| *H05B 39/02* | (2006.01) |
| *H05B 39/04* | (2006.01) |
| *H05B 41/36* | (2006.01) |
| *H05B 41/16* | (2006.01) |
| *H05B 41/24* | (2006.01) |
| *G05F 1/00* | (2006.01) |
| *H01J 11/04* | (2006.01) |
| *H01J 15/04* | (2006.01) |
| *H01J 13/48* | (2006.01) |
| *H01J 17/36* | (2006.01) |

(52) U.S. Cl. ..... 315/189; 315/209 R; 315/246; 315/250; 315/291; 315/312; 315/326

(58) Field of Classification Search ..... 315/185 R, 315/189; *H05B 41/295*

See application file for complete search history.

(56) References Cited

U.S. PATENT DOCUMENTS

| | | | | |
|---|---|---|---|---|
| 4,145,638 | A | 3/1979 | Kaneda | |
| 5,589,740 | A | 12/1996 | Rudolph et al. | |
| 7,034,465 | B2 * | 4/2006 | Liess et al. | 315/64 |

FOREIGN PATENT DOCUMENTS

| | | | |
|---|---|---|---|
| DE | 4425859 | A1 | 1/1996 |
| EP | 0395159 | A1 | 10/1990 |
| JP | 01167988 | A * | 7/1989 |

* cited by examiner

*Primary Examiner* — Douglas W Owens
*Assistant Examiner* — Dedei K Hammond

(57) ABSTRACT

In various embodiments, a circuit arrangement for operating a series circuit of a first and a second low-pressure gas-discharge lamp is provided, which may include an input with a first and a second input connection for application of a supply voltage; an output with a first arrangement, which has a first and a second connection pair for connection of the first lamp, and a second arrangement, which has a first and a second connection pair for connection of the second lamp, wherein a first connection of the second pair of the first arrangement is coupled to a first connection of the first pair of the second arrangement; a resonant circuit; and a capacitive voltage divider, which has a first capacitor, which is coupled in parallel with the first arrangement, and a second capacitor, which is coupled in parallel with the second arrangement.

6 Claims, 1 Drawing Sheet

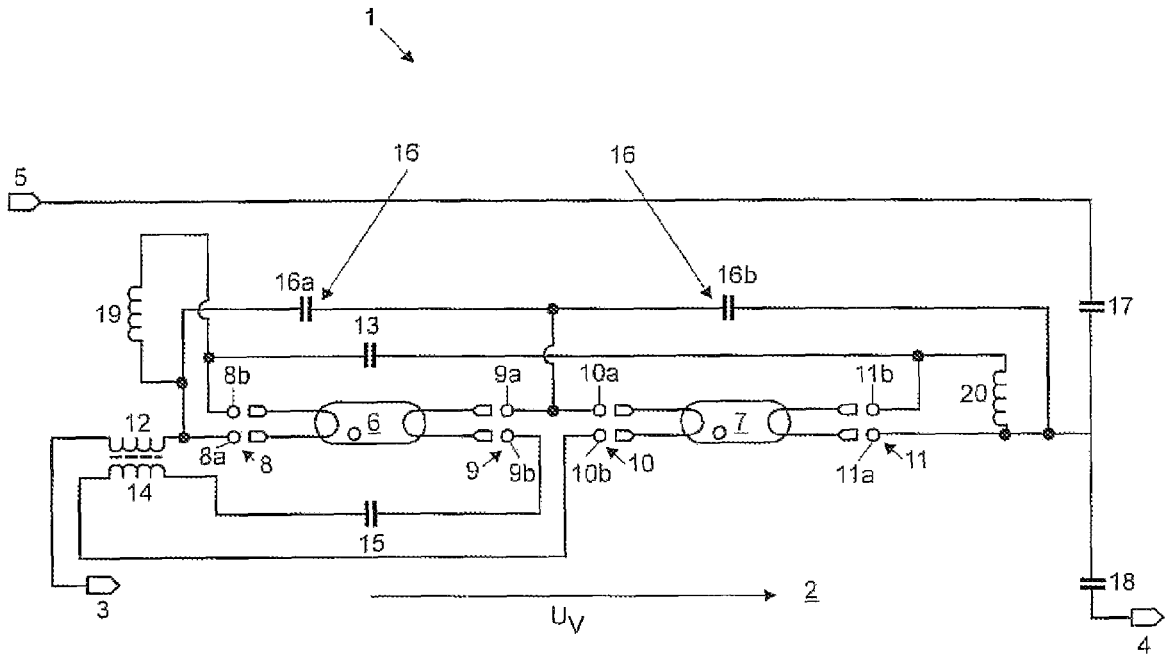
1
5
16
16
16a
16b
19
13
17
8b
9a
10a
11b
20
12
6
7
8a
8
9
9b
10b
10
11a
11
14
15
3
2
$U_V$
18
4

CIRCUIT ARRANGEMENT FOR OPERATING A SERIES CIRCUIT OF AT LEAST TWO LOW-PRESSURE GAS-DISCHARGE LAMPS, AND A CORRESPONDING METHOD

CROSS-REFERENCE TO RELATED APPLICATION

This application claims priority to German Patent Application Serial No. 10 2009 022 072.0, which was filed May 20, 2009, and is incorporated herein by reference in its entirety.

TECHNICAL FIELD

Various embodiments relate to a circuit arrangement for operating a series circuit of at least two low-pressure gas-discharge lamps, and a corresponding method.

BACKGROUND

Circuit arrangements for operating a series circuit of a plurality of low-pressure gas-discharge lamps are already known from the prior art. Circuit arrangements such as these have a resonant circuit including a resonant inductor and a resonant capacitor; the resonant capacitor is connected in parallel with the series circuit of the gas-discharge lamps. Furthermore, at least one so-called sequence start capacitor is in general used in this case, which, when two lamps are connected in series, is connected in parallel with one of the two lamps. This makes it possible to reduce the effectively required starting voltage for the series circuit of the lamps since, until the lamp which is not capacitively bridged is started, virtually all of the voltage which is applied across the series circuit is applied to this lamp, which is started before the other lamp. This ensures sequential starting of the lamps (sequence) and the required total starting voltage for this configuration results approximately from the starting voltage plus the burning voltage of one lamp. One disadvantage in this case is the fact that the total voltage across the lamps is in practice also applied to one lamp during the preheating of the lamps. This value must not exceed a maximum value since, otherwise, the lamps would be started before the electrodes have been adequately preheated, and this would have a very negative influence on the ability of the lamps to withstand switching.

In the present case, there is particular interest in the preheating of electrodes of the gas-discharge lamps. It is prior art for additional heating windings to be used on the resonant inductor for this purpose. However, a procedure such as this results on the one hand in not inconsiderable continuous heating power levels in the electrodes, which has a negative influence on the efficiency of the overall system, including the circuit arrangement and the gas-discharge lamps. On the other hand, a plurality of heating windings—in general, three additional heating windings are used when two gas-discharge lamps are connected in series—should be wound, should be guided and should be isolated, and this is complex. In particular, the isolation of a large number of additional heating windings is costly. If special induction fittings are used, which provide separate chambers for isolation of the heating windings, considerably less winding space is available for the main winding of the resonant inductor, and it is necessary to use thinner, and therefore higher-resistance, wire. In general, this results in considerable thermal problems in this component.

It is also known for additional heating circuits to be used for preheating electrodes of gas-discharge lamps. In this context, reference is made to the disclosure in document DE 44 25 859 A1. The circuit arrangement described in this document includes a heating circuit which can be used to preheat the electrodes of two gas-discharge lamps. When two lamps are connected in series, a heating circuit such as this has a separate heating transformer, a bridge rectifier, two transistors (one of which is a power MOSFET that is resistant to the starting voltage), a plurality of diodes, and a multiplicity of non-reactive resistors. A heating circuit such as this makes it possible to ensure adequate preheating of the electrodes of the gas-discharge lamps. However, one particular requirement is to achieve reliable preheating of the electrodes of at least two series-connected gas-discharge lamps without having to use a multiplicity of additional components.

SUMMARY

In various embodiments, a circuit arrangement for operating a series circuit of a first and a second low-pressure gas-discharge lamp is provided, which may include an input with a first and a second input connection for application of a supply voltage; an output with a first arrangement, which has a first and a second connection pair for connection of the first lamp, and a second arrangement, which has a first and a second connection pair for connection of the second lamp, wherein a first connection of the second pair of the first arrangement is coupled to a first connection of the first pair of the second arrangement; a resonant circuit; and a capacitive voltage divider, which has a first capacitor, which is coupled in parallel with the first arrangement, and a second capacitor, which is coupled in parallel with the second arrangement.

BRIEF DESCRIPTION OF THE DRAWINGS

The drawing is not necessarily to scale, emphasis instead generally being placed upon illustrating the principles of various embodiments. In the following description, various embodiments are described with reference to the following drawing, in which the single FIGURE schematically illustrates a circuit arrangement according an embodiment.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide a circuit arrangement for operating a series circuit of at least one first low-pressure gas-discharge lamp and at least one second low-pressure gas-discharge lamp, having an input with a first input connection and a second input connection for application of a supply AC voltage, an output with at least one first connection arrangement, which has a first connection pair and a second connection pair for connection of the first low-pressure gas-discharge lamp, and a second connection arrangement, which has a first connection pair and a second connection pair for connection of the second low-pressure gas-discharge lamp, wherein a first connection of the second connection pair of the first connection arrangement is coupled to a first connection of the first connection pair of the second connection arrangement, a resonant circuit having a resonant inductor, which is coupled between the first input connection and a first connection of the first connection pair of the first connection arrangement, and having a resonant capacitor, which is coupled between the first connection pair of the first connection arrangement and the second connection pair of the second connection arrangement. Various embodiments also provide a method for operating a series circuit of at least one first low-pressure gas-discharge lamp and one second low-pressure gas-discharge lamp on a circuit arrangement such as this.

Various embodiments provide a solution as to how the electrodes of at least two low-pressure gas-discharge lamps can be reliably preheated, and can be operated with low continuous heating losses, with as little technical complexity as possible.

Various embodiments provide for the circuit arrangement to also have a capacitive voltage divider. This voltage divider has a first capacitor, which is coupled in parallel with the first connection arrangement, and a second capacitor, which is coupled in parallel with the second connection arrangement.

The effect according to various embodiments may accordingly be achieved by a capacitive voltage divider, by means of which an electrical voltage, which is applied between the first connection pair of the first connection arrangement and the second connection pair of the second connection arrangement, is divided. This may make it possible to increase the electrical total voltage which is applied to the resonant capacitor and therefore across the lamps during preheating above a value which is permissible for a single gas-discharge lamp, and therefore to increase the preheating current in this branch without enlarging the resonant capacitor, whose capacitance governs the continuous heating losses. This therefore also may increase the ratio of the current level of the current flowing during preheating via the "outer" electrodes—those electrodes which are coupled to the first connection pair of the first connection arrangement and to the second connection pair of the second connection arrangement—to the current level of this current during operation (that is to say after the gas-discharge lamps have been started). In other words, the ratio of the current level of the continuous heating current to the current level of the preheating current, or rather the ratio of the continuous heating power to the preheating power, is reduced in this way. This reduction may result from the fact that the current level of the current flowing via the "outer" electrodes of the gas-discharge lamps and via the resonant capacitor is governed directly by the amplitude of the voltage applied to the resonant capacitor.

On the one hand, the circuit arrangement according to various embodiments may make it possible to reliably preheat the outer electrodes of the gas-discharge lamps; on the other hand, the circuit arrangement according to various embodiments may result in considerably reduced losses during continuous operation. With the circuit arrangement according to various embodiments, this is done without using a multiplicity of expensive, active and passive components, such as those used in the subject matter according to document DE 44 25 859 A1. The circuit arrangement according to various embodiments may achieve the above effect with only one capacitive voltage divider, as a result of which it can be produced more cost-effectively and with fewer components than the conventional circuit arrangements.

The capacitance values of both the first and the second capacitor may be lower than the capacitance value of the resonant capacitor. This may allow reliable starting of the gas-discharge lamps. By way of example, the capacitance values of the first capacitor and of the second capacitor may be 5% to 25% of the capacitance value of the resonant capacitor. On the other hand, the first capacitor and the second capacitor should be chosen to be sufficiently large that the parasitic capacitances of the first connection arrangement and of the second connection arrangement do not influence the voltage distribution across the lamps. One embodiment provides that for an operating frequency of the supply AC voltage in a value range between about 40 kHz and about 50 kHz, the first capacitor and the second capacitor each has a capacitance value from a value range from 10 pF to 5 nF, e.g. from a value range from 100 pF to 2.5 nF. This satisfies the requirements mentioned above with respect to the voltages on the gas-discharge lamps. In one embodiment, the capacitance value of the first capacitor may be 1 nF, the capacitance value of the second capacitor may be 560 pF, and the capacitance value of the resonant capacitor may be 10 nF.

The capacitance value of the first capacitor may differ from the capacitance value of the second capacitor. This may ensure that the gas-discharge lamps are started sequentially, that is to say one after the other. This is because the different capacitance values of the two capacitors result in the voltage initiating the discharge in one of the gas-discharge lamps first of all, which results directly in an increase in the voltage across the other gas-discharge lamp, and in consequence in the starting of this gas-discharge lamp. The ratio of the capacitance values on the two capacitors is preferably in a value range from 0.5 to 0.8. By way of example, this ratio may be 2/3.

It has been found to be advantageous for an additional winding to be wound on the resonant inductor which is coupled to a second connection of the second connection pair of the first connection arrangement, and to a second connection of the first connection pair of the second connection arrangement. This then allows preheating of the "inner" electrodes of the gas-discharge lamps, which are connected to the second connection pair of the first connection arrangement and to the first connection pair of the second connection arrangement. In this case as well, the ratio of the continuous heating current to the preheating current is reduced in this case to a comparable extent to that in the outer electrodes, because the voltage on the resonant inductor during preheating and starting is, to a first approximation, proportional to the voltage on the resonant capacitor. In consequence, the number of turns on the secondary heating winding, and therefore the continuous heating losses, are reduced. In comparison to the conventional circuit arrangements, in which three or more additional windings are wound on the resonant inductor, the present circuit arrangement may require only a single additional winding on the resonant inductor (assuming that two gas-discharge lamps are being operated). As a component, the resonant inductor can be manufactured much more easily and more cost-effectively in comparison to the prior art; the additional winding can be isolated from the main winding of the resonant inductor without major complexity. Furthermore, more winding space is available for the main winding of the resonant inductor, thus effectively counteracting the thermal problems which occur in the prior art.

In order to further reduce the continuous heating losses and the pin currents of the gas-discharge lamps, it is possible to couple a reactive element, e.g. an inductor, between the connections of the first connection pair of the first connection arrangement and/or between the connections of the second connection pair of the second connection arrangement.

A method according to various embodiments is designed for operating a series circuit of at least one first low-pressure gas-discharge lamp and one second low-pressure gas-discharge lamp on a circuit arrangement of the generic type mentioned initially. The method provides that an electrical voltage which is applied between the first connection pair of the first connection arrangement and the second connection pair of the second connection arrangement is divided by means of a capacitive voltage divider, which has a first capacitor, which is coupled in parallel with the first connection arrangement, and a second capacitor, which is coupled in parallel with the second circuit arrangement.

Various embodiments, which have been described with reference to the circuit arrangement according to various embodiments, and their advantages apply in a corresponding manner to the method according to various embodiments.

A circuit arrangement 1, which is illustrated in the FIGURE, may include an input 2 with a first input connection 3 and a second input connection 4. The second input connection 4 represents a reference potential for a control unit, e.g. implemented as a controller such as a microcontroller (any other control logic circuit may be provided in alternative embodiments) which is not illustrated in the FIGURE. This reference potential is likewise coupled to an inverter, which is not illustrated in the FIGURE but can be controlled by the control unit and provides a supply AC voltage $U_V$. This supply AC voltage $U_V$ is applied between the first and the second input connections 3, 4. The inverter generates the supply AC voltage $U_V$ from an intermediate-circuit DC voltage, which is applied to an intermediate-circuit capacitor that is not illustrated in the FIGURE. The intermediate-circuit DC voltage is in this case applied between an intermediate-circuit pole 5 and the reference potential 4 of the control unit, e.g. the controller.

The circuit arrangement 1 furthermore includes an output with a first connection arrangement and a second connection arrangement, respectively for connection of a low-pressure gas-discharge lamp 6, 7. The first connection arrangement may include a first connection pair 8 with a first connection and a second connection 8*a*, 8*b*, as well as a second connection pair 9 with a first connection and a second connection 9*a*, 9*b*. The second connection arrangement correspondingly includes a first connection pair 10 with a first connection 10*a* and a second connection 10*b*, as well as a second connection pair 11 with a first connection 11*a* and a second connection 11*b*.

The first connection 9*a* of the second connection pair 9 of the first connection arrangement is connected directly to the first connection 10*a* of the first connection pair 10 of the second connection arrangement. This results in the two gas-discharge lamps 6, 7 being connected in series.

The first input connection 3 of the input 2 is coupled via a resonant inductor 12 to the first connection 8*a* of the first connection pair 8 of the first connection arrangement. Together with a resonant capacitor 13, the resonant inductor 12 forms a resonant circuit in the circuit arrangement 1. In this case, the resonant capacitor 13 is connected between the second connection 8*b* of the first connection pair 8 of the first connection arrangement and the second connection 11*b* of the second connection pair 11 of the second connection arrangement. In various embodiments, the inductance value of the resonant inductor 12 is 1.3 mH, and the capacitance value of the resonant capacitor 13 is 7.5 nF.

In addition to the resonant inductor 12, an additional winding 14 may be wound on the same component, via which the inner electrodes of the gas-discharge lamps 6, 7 can be preheated. In this case, the inner electrodes of the gas-discharge lamps 6, 7 mean those electrodes which are connected to the second connection pair 9 of the first connection arrangement and to the first connection pair 10 of the second connection arrangement. The additional winding 14 is coupled via a capacitor 15 to the second connection 9*b* of the second connection pair 9 of the first connection arrangement. On the other hand, the additional winding 14 is connected to the second connection 10*b* of the first connection pair 10 of the second connection arrangement.

Those electrodes of the gas-discharge lamps 6, 7 which are coupled to the first connection pair 8 of the first connection arrangement and to the second connection pair 11 of the second connection arrangement are referred to in the following text as outer electrodes. In order to ensure reliable preheating of the outer electrodes of the gas-discharge lamps 6, 7, a capacitive voltage divider 16 is connected in parallel with the resonant capacitor 13. The capacitive voltage divider 16 includes a first capacitor 16*a* and a second capacitor 16*b*. In this case, the first capacitor 16*a* is connected between the first connection 8*a* of the first connection pair 8, and the first connection 9*a* of the second connection pair 9 of the first connection arrangement. In other words, the first capacitor 16*a* is connected in parallel with the first connection arrangement. The second capacitor 16*b* is connected between the first connection 10*a* of the first connection pair 10, and the first connection 11*a* of the second connection pair 11 of the second connection arrangement. That is to say, the second capacitor 16*b* is connected in parallel with the second connection arrangement. In general, the capacitive voltage divider 16 should be coupled to the outer connections 8, 11, that is to say should be connected on the one hand to one of the connections 8*a* or 8*b* and on the other hand to one of the connections 11*a* or 11*b*. The junction point arranged between the capacitors 16*a*, 16*b* should be connected to one and only one of the connections 9 (9*a* or 9*b*) or 10 (10*a* or 10*b*). The capacitance values of the first and of the second capacitor 16*a*, 16*b* are, in the exemplary embodiment, 1 nF and 560 pF, respectively.

Furthermore, the circuit arrangement 1 has a first coupling capacitor and a second coupling capacitor 17, 18. The first connection 11*a* of the second connection pair 11 of the second connection arrangement is connected via the first coupling capacitor 17 to the intermediate-circuit pole 5, that is to say it is galvanically decoupled from the intermediate-circuit pole 5 by means of the first coupling capacitor 17. On the other hand, the first connection 11*a* of the second connection pair 11 of the second connection arrangement is connected to the reference potential 4 of the control unit, e.g. the controller, via the second coupling capacitor 18. The two coupling capacitors 17, 18 may ensure that no direct currents can flow via the gas-discharge lamps 6, 7. Direct currents such as these could lead to evident inhomogeneity of the light emitted from the gas-discharge lamps 6, 7 (cataphoresis). In addition, the symmetrical arrangement of the coupling capacitors 17, 18 may result in the effect that this minimizes the current load on the intermediate-circuit capacitor.

Furthermore, an inductor 19 is connected between the first connection and the second connection 8*a*, 8*b* of the first connection pair 8 of the first connection arrangement. An inductor 20 is correspondingly connected between the first connection and the second connection 11*a*, 11*b* of the second connection pair 11 of the second connection arrangement. The purpose of the inductors 19, 20 is in this case to minimize the continuous heating losses and the pin currents of the gas-discharge lamps 6, 7.

The method of operation of the circuit arrangement 1 will be explained in more detail in the following text:

First of all, the intermediate-circuit DC voltage is provided, specifically for example by an operator closing a mains switch. When the intermediate-circuit DC voltage is applied to the intermediate-circuit capacitor, then the control unit, e.g. the controller, is also in operation and it can produce the supply AC voltage $U_V$ by appropriately controlling the inverter. A preheating phase is initiated first of all before the gas-discharge lamps 6, 7 are started, in which the electrodes—specifically both the outer and the inner electrodes—of the gas-discharge lamps 6, 7 are heated. In this case, the electrodes are heated up to a temperature which ensures protective starting of the gas-discharge lamps 6, 7.

The control unit, e.g. the controller, may initiate the preheating phase by setting the frequency of the supply AC voltage $U_V$ to a preheating frequency. During the preheating phase, the supply AC voltage $U_V$ is therefore set such that the gas-discharge lamps 6, 7 are not yet started. The presence of the capacitive voltage divider 16 makes it possible to set the electrical voltage applied to the resonant capacitor 13 during the preheating phase to a value which is higher than the starting voltage of a single gas-discharge lamp 6, 7. This may allow relatively high currents to be applied to the outer electrodes of the gas-discharge lamps 6, 7—the current level of the current flowing via the resonant capacitor 13 is governed by the amplitude on the voltage—thus allowing reliable preheating. At the same time, the use of the capacitive voltage divider 16 may reduce the ratio of the current level of the continuous heating current which flows via the outer electrodes during operation to the current level of the preheating current which flows via the resonant capacitor 13 during the preheating phase. This means that the ratio of the continuous heating power to the preheating power is also reduced. In other words, the current level of the continuous heating current can be reduced, thus achieving reduced continuous heating losses. These losses can be reduced even further with the aid of the inductors 19, 20.

After completion of the preheating phase, the frequency of the supply AC voltage $U_V$ is reduced, such that the gas-discharge lamps 6, 7 are started. The gas-discharge lamps 6, 7 are started sequentially because of the different capacitance values of the capacitors 16*a*, 16*b*. This means that the gas-discharge lamps 6, 7 are started successively.

Overall, this therefore provides a circuit arrangement 1 which allows reliable preheating of electrodes of a series circuit of at least two gas-discharge lamps 6, 7. In this case, the circuit arrangement 1 does not require any additional costly and technically complex preheating circuits; they can be produced cost-effectively, with fewer components. A capacitive voltage divider 16, including a first capacitor and a second capacitor 16*a*, 16*b*, may ensure reliable preheating of the electrodes. There is no need to use a plurality of additional windings on the resonant inductor 12, and just one additional winding 14 is sufficient, which can be wound without major effort and with a few turns.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A circuit arrangement for operating a series circuit of at least one first and at least one second low-pressure gas-discharge lamp, the circuit arrangement comprising:

an input with a first input connection and a second input connection for application of a supply AC voltage;

an output with at least one first connection arrangement, which has a first connection pair and a second connection pair for connection of the first low-pressure gas-discharge lamp, and a second connection arrangement, which has a first connection pair and a second connection pair for connection of the second low-pressure gas-discharge lamp, wherein a first connection of the second connection pair of the first connection arrangement is coupled to a first connection of the first connection pair of the second connection arrangement;

a resonant circuit having a resonant inductor, which is coupled between the first input connection and a first connection of the first connection pair of the first connection arrangement, and having a resonant capacitor, which is coupled between the first connection pair of the first connection arrangement and the second connection pair of the second connection arrangement; and a capacitive voltage divider, which has a first capacitor, which is coupled in parallel with the first connection arrangement, and a second capacitor, which is coupled in parallel with the second connection arrangement, wherein an additional winding is wound on the resonant inductor and is coupled to a second connection of the second connection pair of the first connection arrangement, and to a second connection of the first connection pair of the second connection arrangement.

2. The circuit arrangement as claimed in claim 1, wherein, for an operating frequency of the supply AC voltage in a value range between about 40 kHz and about 50 kHz, the first capacitor and the second capacitor each has a capacitance value from a value range from 10 pF to 5 nF.

3. The circuit arrangement as claimed in claim 2, wherein, for an operating frequency of the supply AC voltage in a value range between about 40 kHz and about 50 kHz, the first capacitor and the second capacitor each has a capacitance value from a value range from 100 pF to 2.5 nF.

4. The circuit arrangement as claimed in claim 1, further comprising: a reactive element coupled at least one of between the connections of the first connection pair of the first connection arrangement and between the connections of the second connection pair of the second connection arrangement.

5. The circuit arrangement as claimed in claim 4, wherein the reactive element comprises an inductor.

6. A method for operating a series circuit of at least one first low-pressure gas-discharge lamp and at least one second low-pressure gas-discharge lamp on a circuit arrangement having an input with a first input connection and a second input connection for application of a supply AC voltage, having an output with at least one first connection arrangement, which has a first connection pair and a second connection pair for connection of the first low-pressure gas-discharge lamp, and a second connection arrangement, which has a first connection pair and a second connection pair for connection of the second low-pressure gas-discharge lamp, wherein a first connection of the second connection pair of the first connection arrangement is coupled to a first connection of the first connection pair of the second connection arrangement, and having a resonant circuit having a resonant inductor, which is coupled between the first input connection and a first connection of the first connection pair of the first connection arrangement, and having a resonant capacitor, which is coupled between the first connection pair of the first connection arrangement and the second connection pair of the second connection arrangement, the method comprising:

Dividing an electrical voltage which is applied between the first connection pair of the first connection arrangement and the second connection pair of the second connection arrangement by means of a capacitive voltage divider, which has a first capacitor, which is coupled in parallel with the first connection arrangement, and a second capacitor, which is coupled in parallel with the second connection arrangement, wherein an additional winding is wound on the resonant inductor and is coupled to a second connection of the second connection pair of the first connection arrangement, and to a second connection of the first connection pair of the second connection arrangement.

* * * * *